United States Patent [19]

Yamamoto et al.

[11] Patent Number: 5,035,081

[45] Date of Patent: Jul. 30, 1991

[54] DOUBLE-HUNG WINDOW

[75] Inventors: Yukio Yamamoto, Uozu; Masahiro Sugiura, Kurobe, both of Japan

[73] Assignee: Yoshida Kogyo K.K., Tokyo, Japan

[21] Appl. No.: 532,174

[22] Filed: Jun. 4, 1990

Related U.S. Application Data

[63] Continuation of Ser. No. 359,497, May 31, 1989, abandoned.

[51] Int. Cl.[5] ..... E05D 15/22

[52] U.S. Cl. ..... 49/161; 49/175

[58] Field of Search ..... 49/176, 161, 172, 175

[56] References Cited

U.S. PATENT DOCUMENTS

| | | | |
|---|---|---|---|
| 1,332,361 | 3/1920 | Schebora | 49/176 |
| 1,530,610 | 3/1925 | Ortleb | 49/176 |
| 1,749,589 | 3/1930 | Kramer | 49/176 X |
| 2,990,589 | 7/1961 | Lynch | 49/176 |
| 3,335,523 | 8/1967 | Isler et al. | 49/176 X |
| 4,475,311 | 10/1984 | Gibson | 49/176 |

FOREIGN PATENT DOCUMENTS 6217577 5/1967 Japan .

*Primary Examiner*—Philip C. Kannan

*Attorney, Agent, or Firm*—Hill, Van Santen, Steadman & Simpson

[57] ABSTRACT

A double-hung window has auxiliary vertical frames mounted on respective left and right stiles of inner and outer sliding sash units without providing respective outer peripheries of rectangular stile-rail assemblies of the inner and the outer sliding sash units with frameworks wherein the inner and the outer sliding sash units are respectively constructed so as to be slidably moved up and down freely through the auxiliary vertical frames along inner and outer guide recesses formed, respectively, in the left and right vertical frame members of a window frame, so that the outer surfaces of the glasses attached to inner and outer sliding sashes can be readily cleaned, and that the weight of the inner and the outer sliding sashes can be reduced so as to reduce the resistance to sliding thereof, thereby enabling the inner and the outer sliding sashes to be slidably moved smoothly.

3 Claims, 13 Drawing Sheets

DOUBLE-HUNG WINDOW

This is a continuation of application Ser. No. 359,497 filed May 31, 1989 now abandoned.

BACKGROUND OF THE INVENTION

1. Field of the Invention

This invention relates to a double-hung window having an inner sliding sash and an outer sliding sash mounted within a window frame so as to be slidably moved up and down, and more particularly to a double-hung window arranged such that the inner and outer sliding sashes may be slidably moved up and down, respectively, in their rectangular stile-rail assemblies of inner and outer sliding sash units without having to mount a framework around the outer periphery of each of the stile-rail assemblies, and the inner and outer sliding sash units may be inclined inwardly about their hinges, respectively.

2. Disclosure of the Prior Art

An example of prior art double-hang windows is disclosed in Japanese Utility Model Publication No. SHO 62-17577.

According to this prior art example, the arrangement is made such that an inner sliding sash is mounted within a window frame on the inside thereof so as to be slidably moved up and down and an outer sliding sash is mounted on the outside thereof so as to be slidably moved up and down, the inner sliding sash comprising an inner sliding sash unit mounted within a frame assembly so that it may be inclined inwardly about its hinge, and the frame assembly being mounted within the window frame on the inside thereof so as to be slidably moved up and down freely.

In such a double-hung window, when the inner sliding sash is slid down and inclined inwardly, the outer surface of the glass of the inner sliding sash can be cleaned readily and simply from the inside.

However, the above-mentioned prior art double-hung window has the following disadvantages.

1. To clean the outer surface of the glass of an outer sliding sash in such a double-hung window, it is necessary to slide up both the inner and outer sliding sashes to their upper positions, respectively, and then effect cleaning by extending the cleaner's hand from the lower opening of the window frame. Therefore, the cleaning operation is very troublesome.
2. Since the inner sliding sash has an inner sliding sash unit mounted within a frame assembly so that it may be inclined inwardly, the weight of the frame assembly becomes heavy, and hence the weight of the inner sliding sash becomes very heavy. Therefore, a high magnitude of force is required to slidably move the inner sliding sash up and down, but also since the left and right vertical frames forming the frame assembly are arranged to slidably move along the left and right vertical frames forming the window frame, the resistance to sliding becomes high.

Therefore, it is not easy to slidably move the inner sliding sash up and down.

SUMMARY OF THE INVENTION

The present invention has been made in view of the above-mentioned circumstances, and has for its object to provide a double-hung window wherein both inner and outer sliding sash units can be inclined inwardly about their hinges to enable the outer surfaces of the glasses of the vertically slidably movable inner and outer sliding sashes to be cleaned simply and readily.

Another object of the present invention is to provide a double-hung window wherein the weight of vertically slidably movable inner and outer sliding sashes is reduced, and auxiliary vertical frames are mounted on the left and right sides of the inner and outer sliding sash units without having to mount a framework around the outer periphery of each of the rectangular stile-rail assemblies of the inner and outer sliding sash units so that the resistance to sliding is reduced to thereby enable the inner and outer sliding sashes to be slidably moved smoothly, whereby the auxiliary vertical frames of the inner and outer sliding sashes can be slidably moved up and down freely along inner and outer guide recesses formed, respectively, in the left and right vertical frame members of a window frame.

To achieve the above-mentioned objects, according to the first aspect of the present invention, there is provided a double-hung window comprising an inner sliding sash mounted so as to be slidably moved up and down freely within a window frame on the inside thereof, the inner sliding sash having an inner sliding sash unit mounted thereon so that it may be inclined inwardly about its hinge, and an outer sliding sash mounted so as to be slidably moved up and down freely within the window frame on the outside thereof, the outer sash sliding sash having an outer sliding sash unit mounted thereon so that it may be inclined inwardly about its hinge, characterized in that the window frame has upper and lower frames configured such that when the inner sliding sash is located at its lowermost position and the outer sliding sash is located at its uppermost position the upper portion of the inner sliding sash overlaps the lower portion of the outer sliding sash with each other, whilst when the inner sliding sash is located at its uppermost position and the outer sliding sash is located at its lowermost position the lower portion of the inner sliding sash is spaced apart from the upper portion of the outer sliding sash so that the outer sliding sash may be inclined inwardly about its hinge.

To achieve the above-mentioned objects, according to the second aspect of the present invention, there is provided a double-hung window, characterized in that the inner sliding sash as set forth in the first aspect comprises an inner sliding sash unit auxiliary vertical frames connected, respectively, to left and right stiles of the inner sliding sash unit, hinges fixedly secured, respectively, to the lower parts of the opposite inside portions of the auxiliary vertical frames, engaging members fixedly secured, respectively, to the lower parts of the opposite outside portions of the left and right stiles of the inner sliding sash unit and which are engaged with the hinges so that the inner sliding sash unit may be inclined inwardly about its hinge relative to the auxiliary vertical frames, inner sliding sash locks mounted, respectively, across each side of the upper rail of the inner sliding sash unit and each of the left and right auxiliary vertical frames, and connecting members and socket members mounted on the left and right auxiliary vertical frames at upper and lower positions thereof, respectively, so that they may be vertically slidably engaged with inside guide recesses formed so as to extend, respectively, in the longitudinal direction of the opposite inside portions of the left and right vertical frame members of the window frame.

To achieve the above-mentioned objects, according to the third aspect of the present invention, there is provided a double-hung window, characterized in that the outer sliding sash as set forth in the first aspect comprises an outer sliding sash unit, auxiliary vertical frame members, connected, respectively, to the left and right stiles of the outer sliding sash unit, hinges fixedly secured, respectively, to the lower parts of the opposite inside portions of the auxiliary vertical frames, engaging members fixedly secured, respectively, to the lower parts of the outside portions of the left and right stiles of the outer sliding sash unit and which are engaged with the hinges so that the outer sliding sash unit may be inclined inwardly about its hinge relative to the auxiliary vertical frames, outer sliding sash locks mounted, respectively, across each side of the upper rail of the outer sliding sash unit and each of the left and right auxiliary vertical frames, and connecting members and socket members mounted on the left and right auxiliary vertical frames at upper and lower positions thereof, respectively, so that they may be vertically slidably engaged with outside guide recesses formed so as to extend, respectively, in the longitudinal direction of the opposite inside portions of the left and right vertical frame members of the window frame.

The present invention incorporating the above-mentioned aspects has the following advantages.

Stating in brief, when the inner sliding sash is located at its lowermost position and the outer sliding sash is located at its uppermost position and the inner sliding sash unit is inclined inwardly about its hinge, the outer surface of the glass of the inner sliding sash can be cleaned readily. When the inner sliding sash is located at its uppermost position and the outer sliding sash is located at its lowermost position and the outer sliding sliding sash unit is inclined inwardly about its hinge, the outer surface of the glass of the outer sliding sash can be cleaned readily. Further, since each of the inner and outer sliding units is mounted on the left and right vertical frames so that it may be inclined inwardly about its hinge without the need for mounting a framework around each of them, the weight of the inner and outer sliding sashes becomes less than that of the prior art one comprising a framework, and since the connecting members and the socket members connected to the upper and lower parts of the outside portions of the left and right auxiliary vertical frames are allowed to slidably move along the inside and outside guide recesses, formed, respectively, in the opposite inside portions of the window frame, the resistance to sliding of the inner and outer sliding sashes along the window frame can be reduced so that the inner and outer sliding sashes can be slidably moved up and down smoothly.

The above-mentioned and other objects, aspects and advantages of the present invention will become apparent to those skilled in the art from the following detailed description when taken in conjunction with the accompanying drawings in which a preferred embodiment incorporating the principles of the present invention is shown by way of illustration only.

DETAILED DESCRIPTION OF PREFERRED EMBODIMENTS

One embodiment of the double-hung window according to the present invention will now be described below in detail with reference to the accompanying drawings.

Figure 1:
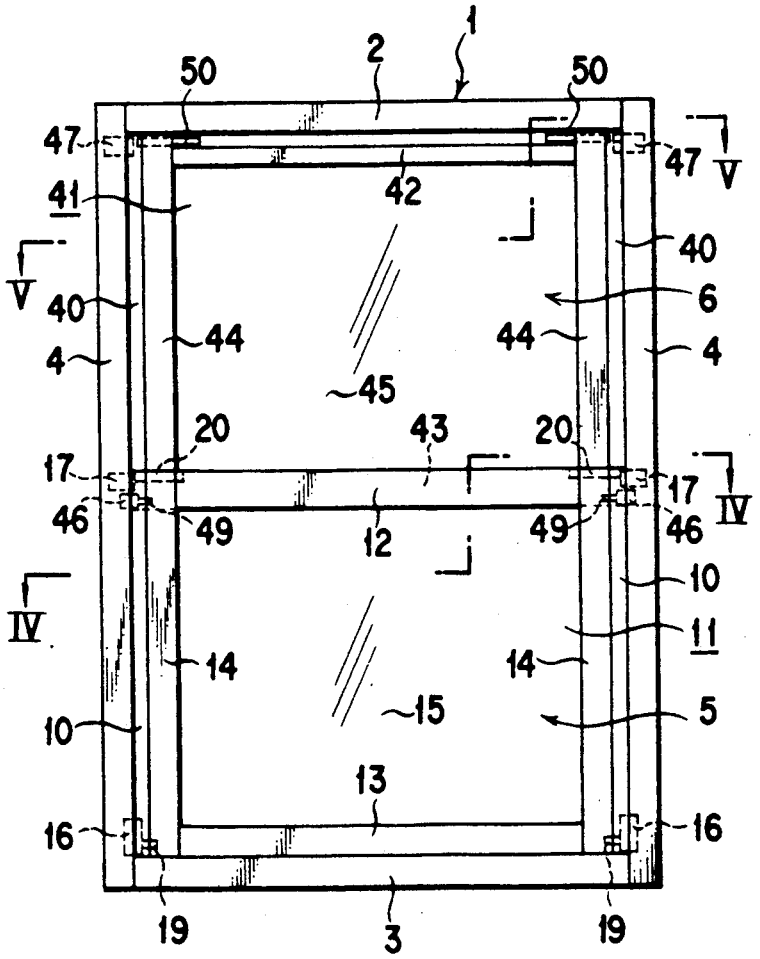
FIG. 1 is a schematic, overall front view of an embodiment of the present invention.

As shown in FIG. 1, a window frame 1 is a rectangular member which is comprised of an upper frame member 2, a lower frame member 3, and left and right vertical frame members 4, 4. An inner sliding sash 5 is mounted within the window frame 1 on the inside thereof in such a manner that it may be vertically slidably moved, and an outer sliding sash 6 is mounted on the outside thereof in the manner such that it may be vertically slidably moved whereby forming a double-hung window.

Figure 4:
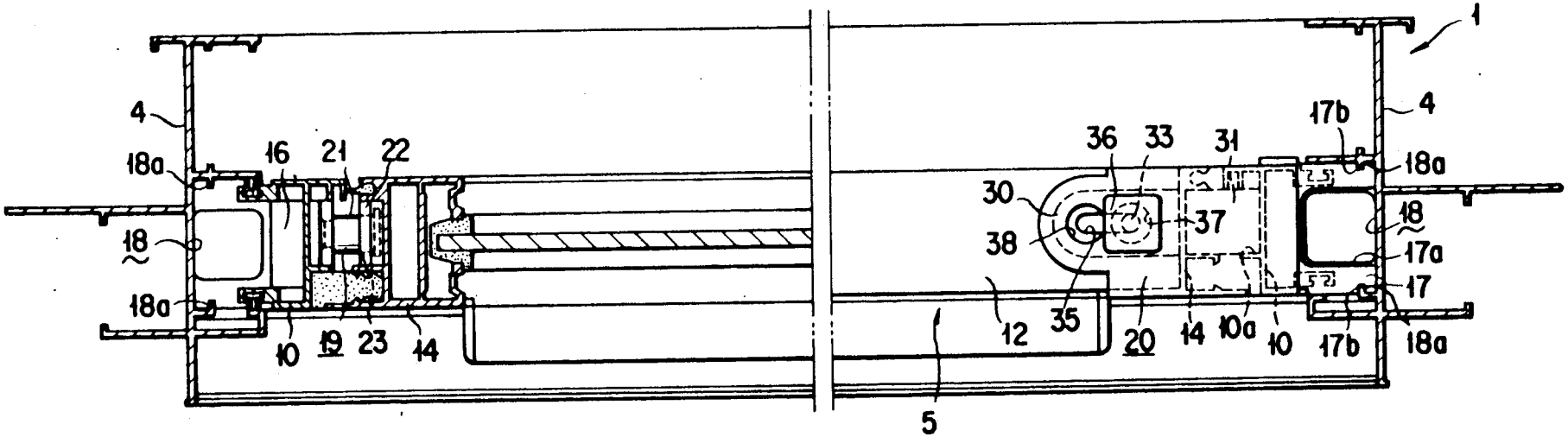
FIGS. 4 and 5 are sectional views of the embodiment taken along lines IV—IV and V—V, respectively, in FIG. 1.

The above-mentioned inner sliding sash 5 is comprised of left and right auxiliary vertical frames 10, 10 and an inner sliding sash unit 11. The inner sliding sash unit 11 is a glazed panel of the type commonly used, i.e., a glass 15 fitted in a rectangular stile-rail assembly which is formed by an upper rail 12, a lower rail 13, and left and right stiles 14, 14. Each of the auxiliary vertical frames 10, 10 has a socket member 16 attached to the lower part thereof, and a connecting member 17 connected to the upper part thereof. As shown in FIG. 4, the socket members 16 and the connecting members 17 are arranged so as to be slidably moved up and down freely along inside guide recesses 18 of the vertical frame members 4, 4 so that the left and right auxiliary vertical frames 10, 10 may be slidably moved up and down.

Each of the auxiliary vertical frames 10 and each of the stiles 14 are pivotally connected by means of a hinge 19 at the lower parts thereof so that the stiles 14 may be inclined inwardly about the hinge. Further, an inner sliding sash lock 20 is mounted on the upper portion of each of the auxiliary vertical frames 10 and that of each of the stiles 14.

Figure 6:
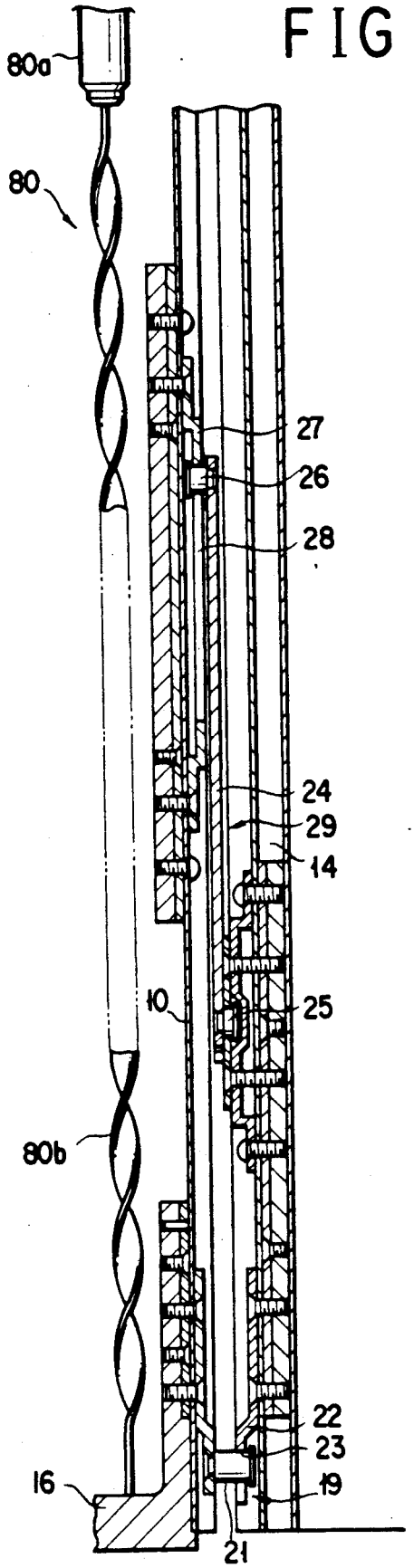
FIGS. 6 , 7 and 8 are a fragmentary longitudinal sectional view, a fragmentary side elevational view, and a fragmentary exploded perspective view, respectively, of a connecting portion of an auxiliary vertical frame of an inner sliding sash and a stile of an inner sliding sash unit.
Figure 7:
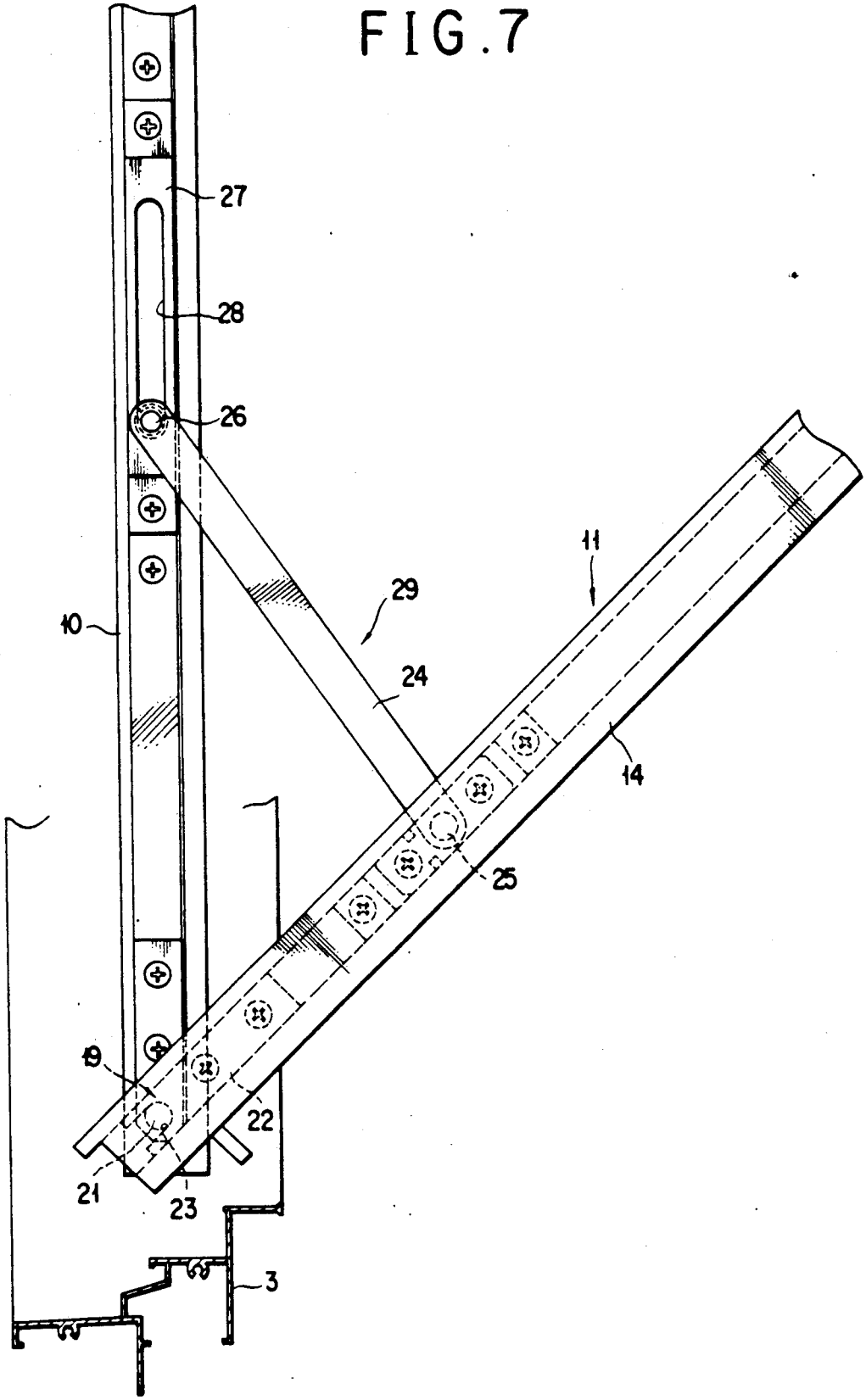
Figure 8:
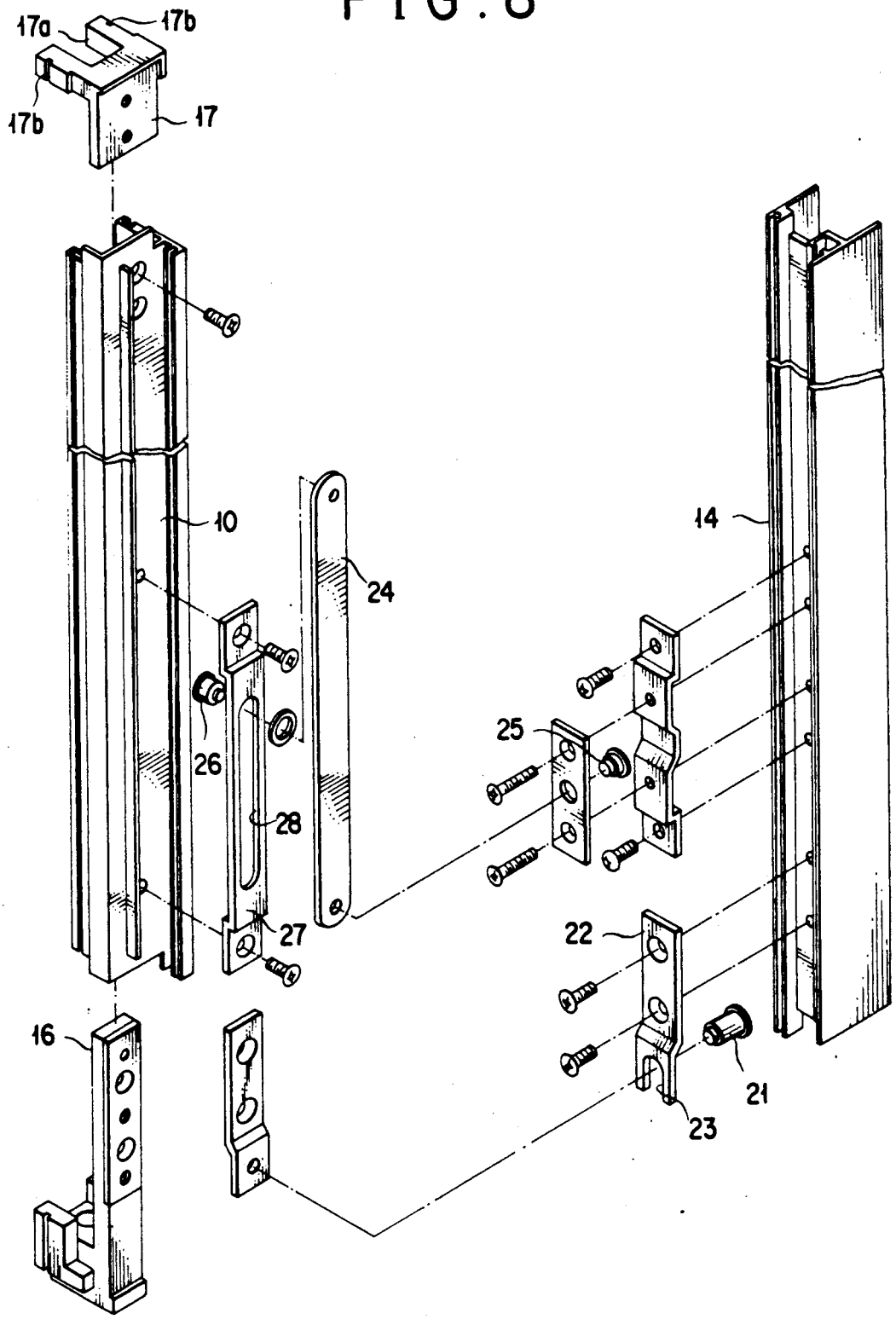

As shown in FIGS. 6, 7 and 8, the above-mentioned hinge 19 comprises a pin-shaped insertion member 21 fitted to the lower part of the auxiliary vertical frame 10, and a plate-shaped engaging member 22 fitted to the lower part of the stile 14. The engaging member 22 has an engaging recess 23 formed therein and adapted to be engaged from above with the insertion member 21 so that the stile 14 may be turned. Further, an arm 24 is pivotally connected to the stile 14 at one end thereof by means of a pin 25, has a pin 26 attached to the other end thereof and which is slidably fitted in an elongated hole 28 formed in a longitudinal plate 27, which is fitted to the above-mentioned auxiliary vertical frame 10, whereby forming an inward inclination stopper 29 for the inner sliding sash unit 11.

Further, in FIG. 6, reference numeral 80 denotes a balancer of which fixed side 80*a* is connected to the side of the upper frame 2 and whose movable side 80*b* is connected to the socket member 16 so that the weight of the inner sliding sash 5 can be carried and held at a predetermined vertical position. Each of the above-mentioned connecting members 17 has a notched recess 17*a* formed therein for insertion of the movable member 80*b* as shown in FIG. 4, and has also grooves 17*b* each adapted to engage with each one of projections 18*a* formed in an inside guide recess 18.

Figure 9:
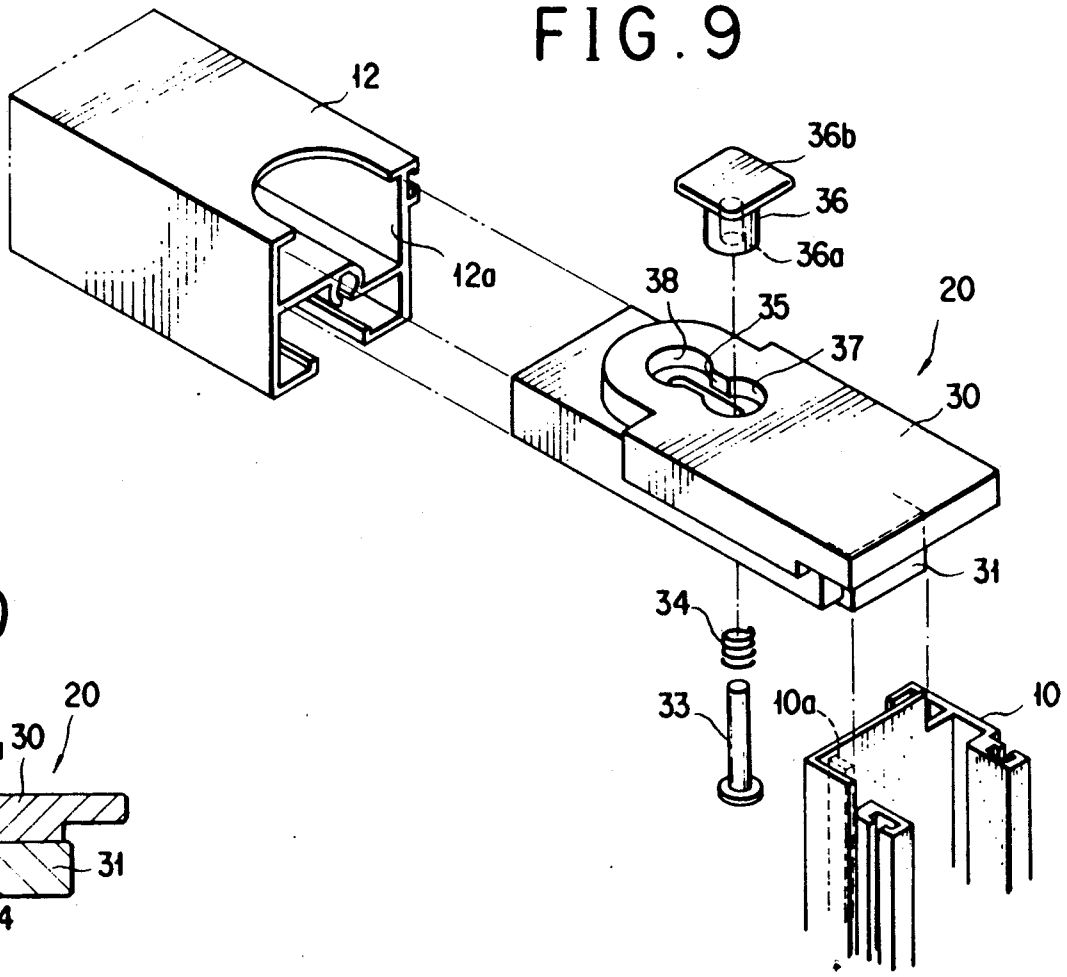
FIGS. 9 and 10 are an exploded perspective view and a longitudinal sectional view, respectively, of an inner sliding sash lock.
Figure 10:
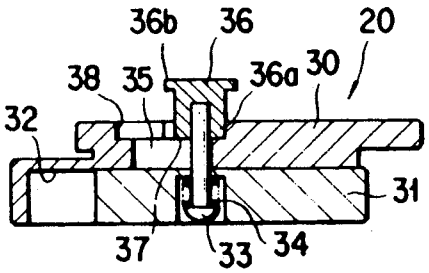

As shown in FIGS. 9 and 10, each of the above-mentioned inner sliding lock 20 comprises a lock body 30 adapted to be fitted in a hollow portion 12*a* of the upper rail 12 so as to be fixedly secured thereto, and a locking rod 31 adapted to be fitted in an inward recess 10*a* formed in the auxiliary vertical frame 10 and which is arranged to be horizontally slidably moved along a guide groove 32 formed in the body 30, and a connecting rod 33 arranged to be slidably moved up and down and biased downwardly by means of a spring 34. The connecting rod 33 has a knob 36 attached thereto and which projects above the elongated hole 35 formed in the lock body 30. The knob 36 consists of a lower cylindrical body 36*a* and an upper rectangular body 36*b*. The above-mentioned elongated hole 35 has a first circular recess 37 and a second circular recess 38 formed therein on the longitudinal both sides thereof and in each of which the lower cylindrical body 36*a* can be fitted. The arrangement is made such that when the knob 36 is held and lifted by the operator's hand to pull up the connecting rod 33 against the biasing force of the spring 34 the lower cylindrical body 36*a* is withdrawn either from the first circular recess 37 or from the second circular recess 38, and when the connecting rod 33 is moved in the elongated hole 35 the locking rod 31 is moved either to a projecting position where it is fitted in the inward recess 10*a* of the auxiliary vertical frame 10 or to a withdrawal position where it is withdrawn therefrom, and further when the knob 36 is released from the operator's hand the lower cylindrical body 36*a* is fitted either in the first circular recess 37 or in the second circular recess 38 by the resilient force of the spring 34 so that the locking rod 31 may be held either at the above-mentioned projecting position or at the withdrawal position.

Figure 5:
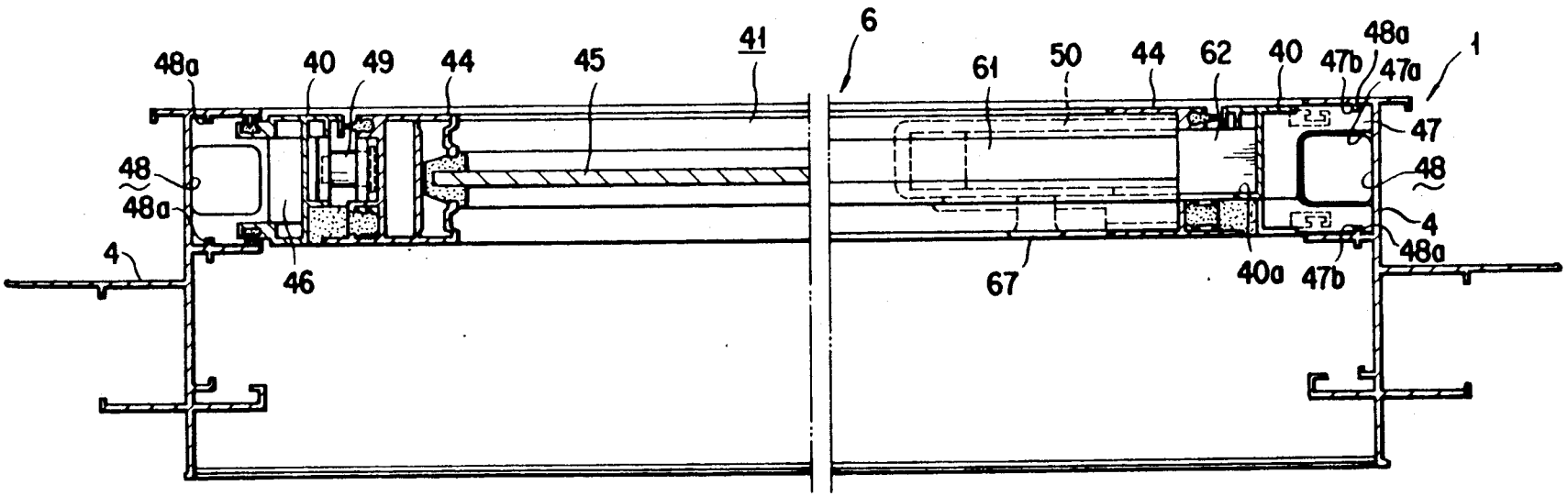

The above-mentioned outer sliding sash 6 comprises, as shown in FIG. 1, left and right auxiliary vertical frames 40, 40 and an outer sliding sash unit 41. The outer sliding sash unit 41 is a glazed panel of the type commonly used, i.e., a glass 45 fitted in a rectangular stile-rail assembly which is formed by an upper rail 42, a lower rail 43, and left and right stiles 44, 44. Each of the auxiliary vertical frames 40 has a socket member 46 attached to the lower part thereof, and a connecting member 47 connected to the upper part thereof. As shown in FIG. 5, the socket members 46 and the connecting members 47 are arranged so as to be slidably moved up and down freely along outside guide recesses 48 so that the left and right auxiliary vertical frames 40, 40 may be slidably moved up and down.

Each of the auxiliary vertical frames 40 and each of the stiles 44 are pivotally connected by means of a hinge 49 at the lower parts thereof so that the stiles 44 may be inclined inwardly about the hinge. Further, an outer sliding sash lock 50 is mounted on the upper portion of each of the auxiliary vertical frames 40 and that of each of the stiles 44.

Figure 11:
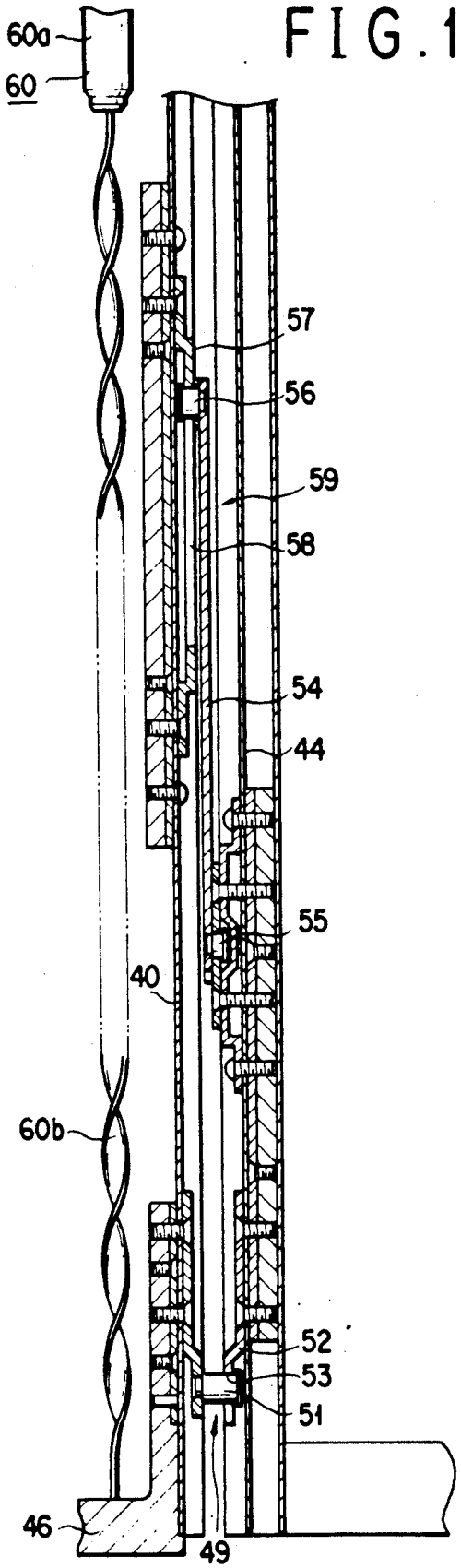
FIGS. 11, 12 and 13 are a fragmentary longitudinal sectional view, a fragmentary side elevational view, and a fragmentary exploded perspective view, respectively, of a connecting portion of an auxiliary vertical frame of an outer sliding sash and a stile of an outer sliding sash unit.
Figure 12:
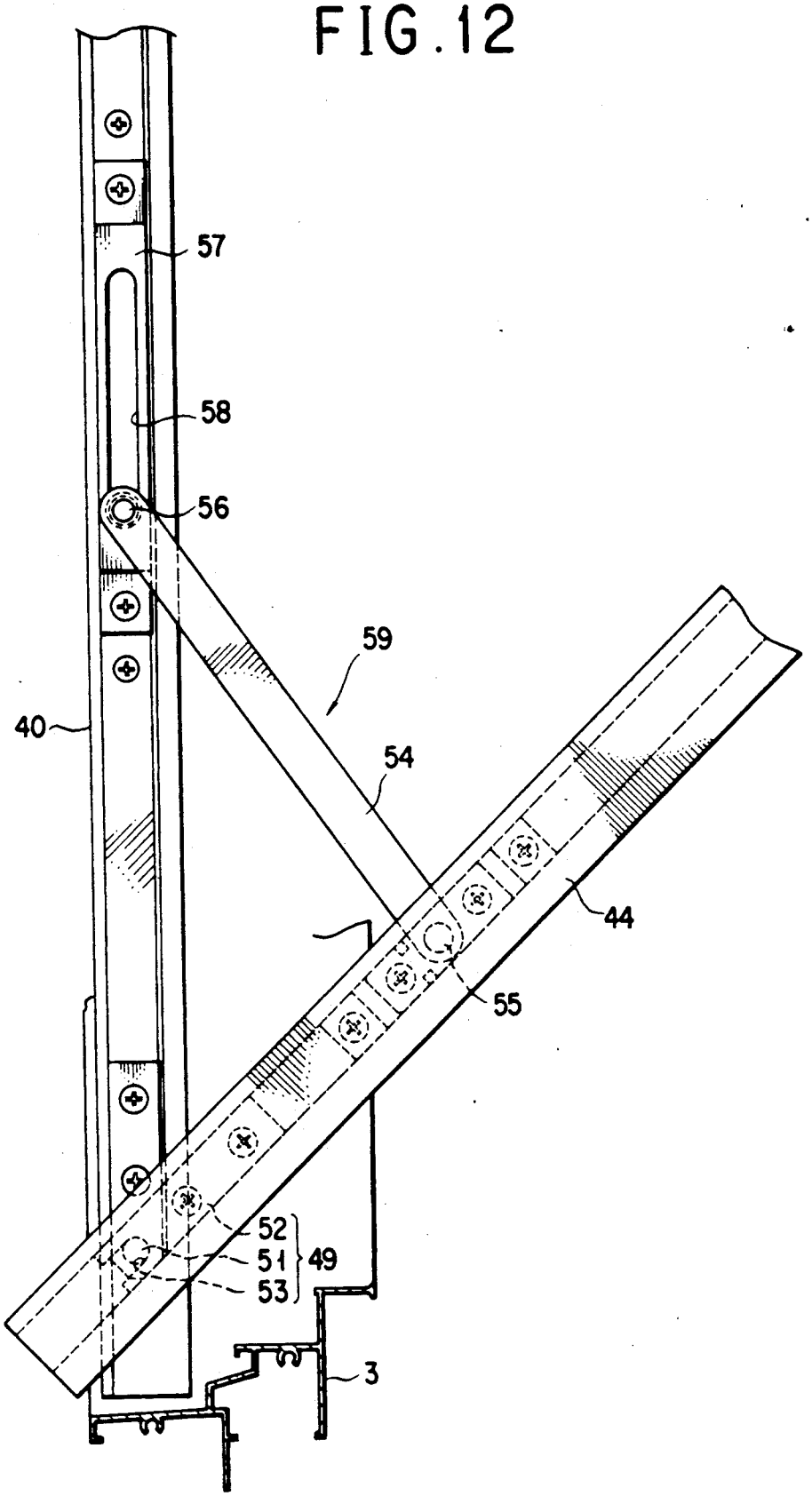
Figure 13:
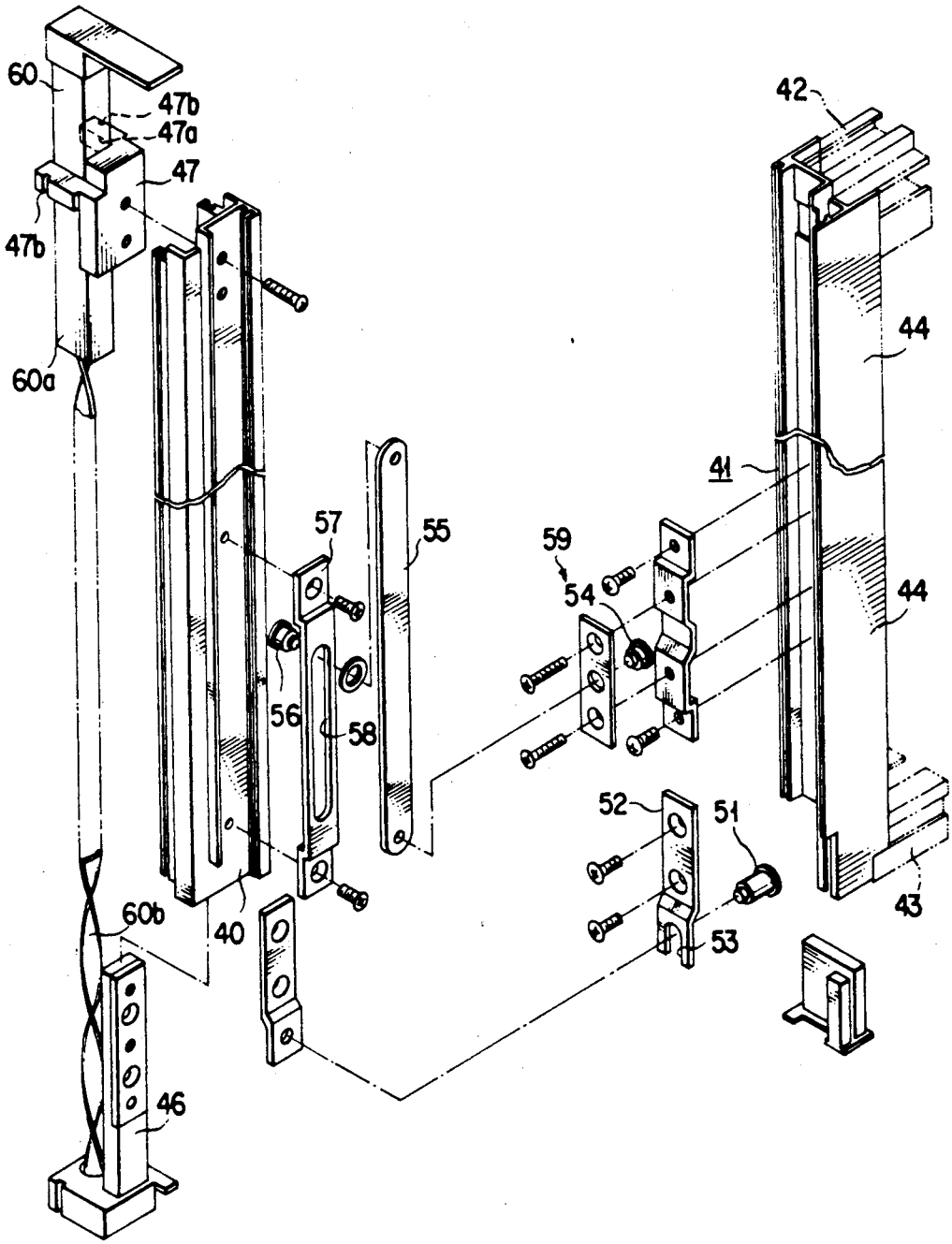

The above-mentioned hinge 49 comprises, as shown in FIGS. 11, 12 and 13, a pin-shaped insertion member 51 fitted to the lower part of the auxiliary vertical frame 40, and a plate-shaped engaging member 52 fitted to the lower part of the stile 44. The engaging member 52 has an engaging recess 53 formed therein and adapted to be engaged from above with the insertion member 51 so that the stile 44 may be turned. Further, an arm 54 is pivotally connected to the stile 44 at one end thereof by means of a pin 55, and has a pin 56 attached to the other end thereof and which is slidably fitted in an elongated hole 58 formed in a longitudinal plate 57, which is fitted to the above-mentioned auxiliary vertical frame 40, whereby forming an inward inclination stopper 59 for the outer sliding sash unit 41.

Further, in FIG. 11, reference numeral 60 denotes a balancer whose fixed side 60*a* is connected to the side of the upper frame 2 and whose fixed side 60*b* is connected to a socket member 46 so that the weight of the outer sliding sash 6 can be carried and held at a predetermined vertical position. Each of the above-mentioned connecting members 47 has a notched recess 47*a* formed therein for insertion of the movable member 60*b* as shown in FIG. 5, and has also grooves 47*b* each adapted to engage with each one of projections 48*a* formed in an outside guide recess 48.

Figure 14:
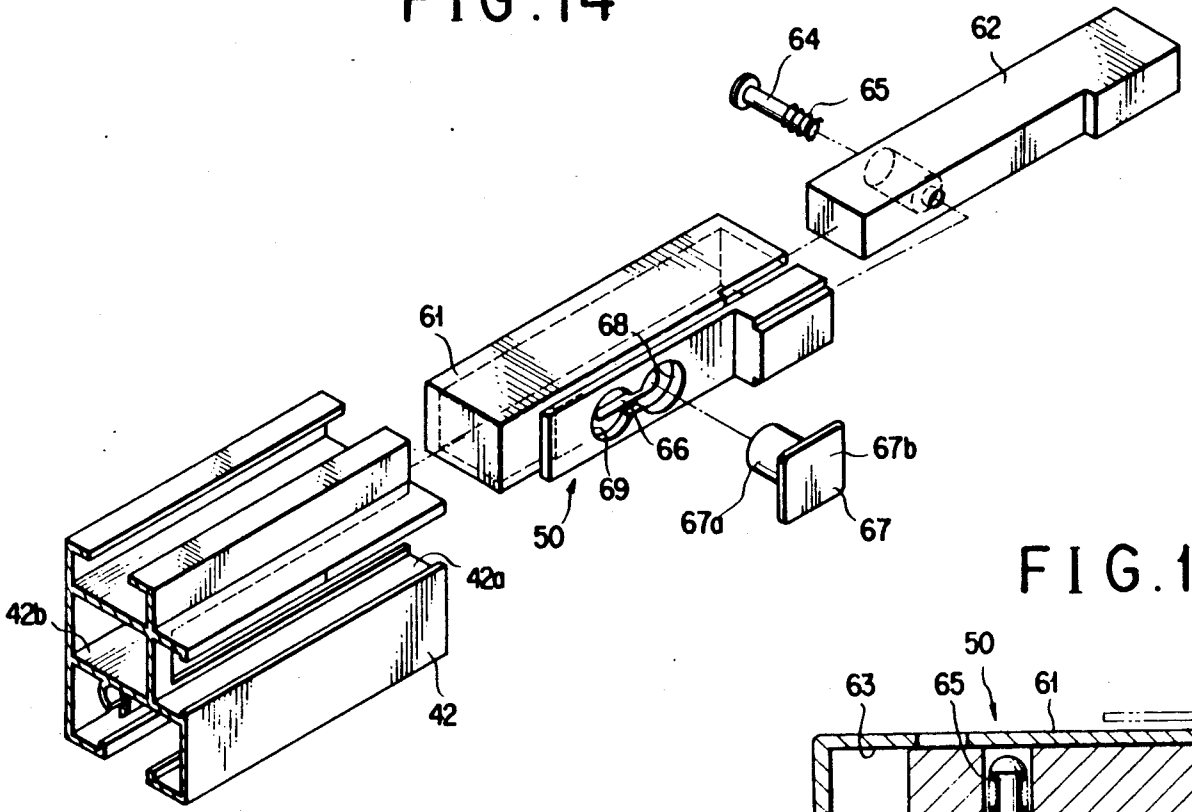
FIGS. 14 and 15 are an exploded perspective view and a longitudinal sectional view, respectively, of an outer sliding sash lock.
Figure 15:
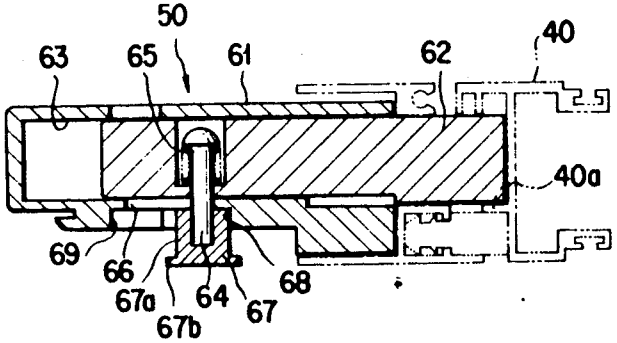

Each of the above-mentioned outer sliding sash lock 50 comprises, as shown in FIGS. 5, 14 and 15, a lock body 61 adapted to be fitted in a recessed groove 42*a* which opens towards the inside and a hollow portion 42*b* of the upper rail 42 so as to be fixedly secured thereto, and a locking rod 62 adapted to be fitted in an inward recess 40*a* formed in the auxiliary vertical frame 40 and which is arranged to be horizontally slidably moved along a guide groove 63 formed in the body 61, and a connecting rod 64 arranged to be horizontally slidably moved and biased inwardly by means of a spring 65. The connecting rod 64 has a knob 67 attached thereto and which projects outside an elongated hole 66 formed in the lock body 61. The knob 67 consists of a lower cylindrical body 67*a* and an upper rectangular body 67*b*. The above-mentioned elongated hole 66 has a first circular recess 68 and a second circular recess 69 formed therein on the longitudinal both sides thereof and in each of which the lower cylindrical body 67*a* can be fitted. The arrangement is made such that when the knob 67 is held and lifted by the operator's hand to pull up the connecting rod 67 against the biasing force of the spring 65 the lower cylindrical body 67*a* is withdrawn either from the first circular recess 68 or from the second circular recess 69, and when the connecting rod 67 is moved in the elongated hole 67 the locking rod 62 is moved either to a projecting position where it is fitted in the inward recess 40*a* of the auxiliary vertical frame 40 or to a withdrawal position where it is withdrawn therefrom, and further when the knob 67 is released from the operator's hand the lower cylindrical body 67*a* is fitted either in the first circular recess 68 or in the second circular recess 69 so that the locking rod 62 may be held either at the above-mentioned projecting position or at the withdrawal position.

Figure 2:
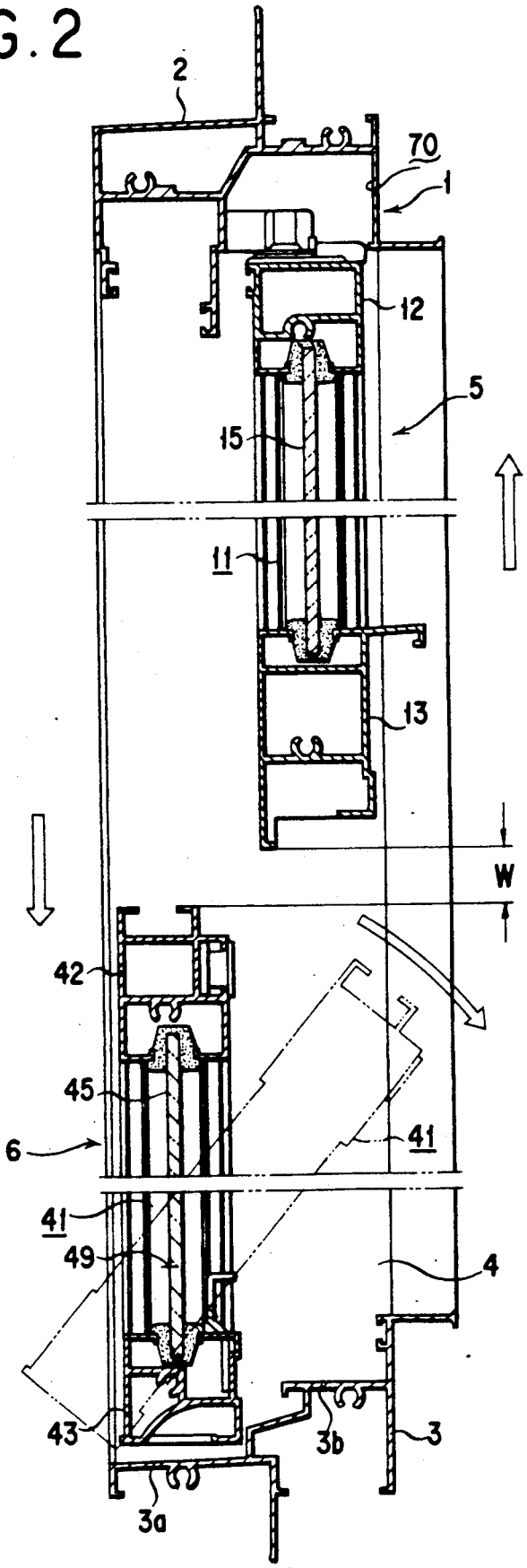
FIGS. 2 and 3 are longitudinal sectional views of the embodiment of the present invention at two different operational positions, respectively.
Figure 3:
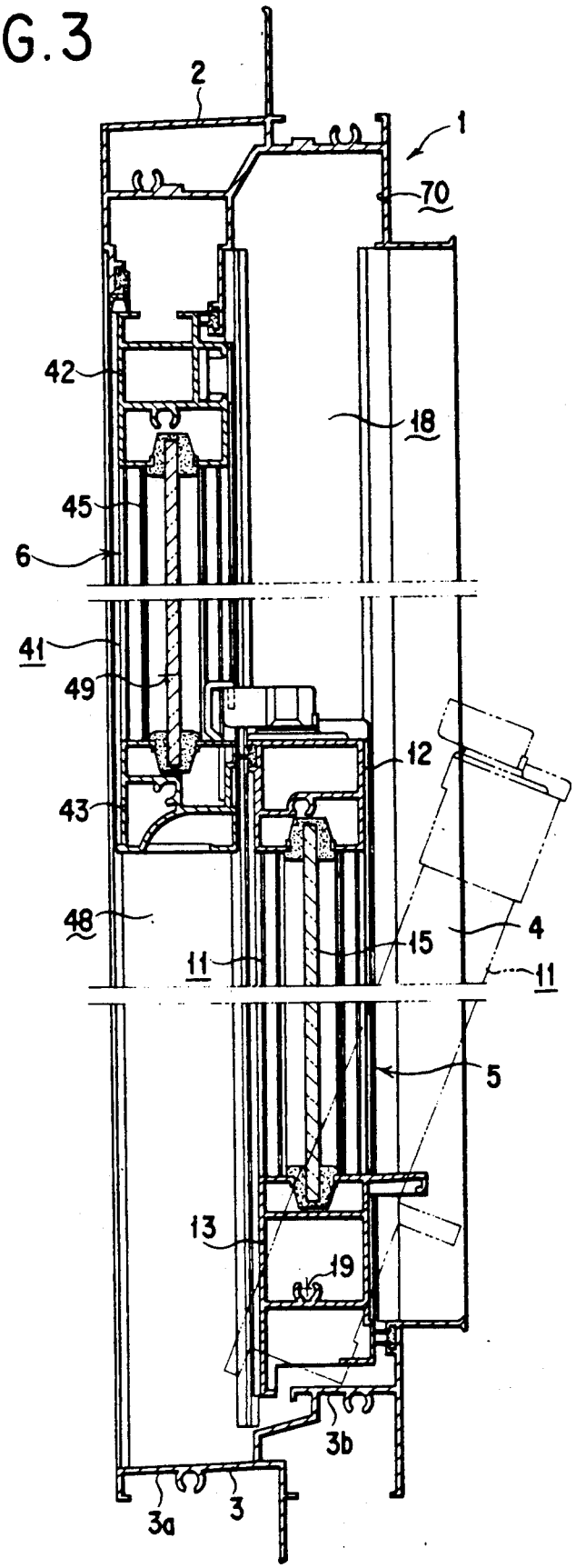

Thus, the inner sliding sash 5 can be slidably moved up and down freely as shown in FIGS. 2 and 3 by allowing it to slidably move up and down through the connecting members 17 and socket members 16 along the inside guide recesses 18. When the inner sliding sash 5 is slidably moved to its lowermost position and the locking rod 31 of the inner sliding sash lock 20 is set at its withdrawal position as shown in FIG. 3, the locking rod 31 is withdrawn from the inward recess 10*a* of the auxiliary vertical frame 10 so that the inner sliding sash unit 10 may be inclined inwardly about the hinge 19, thereby making it possible to clean the outer surface of the inner sliding sash unit 11 readily.

Further, since the upper rail 2 has an inner sliding sash receiving recess 70 formed on the inside thereof and the outer portion 3*a* of the lower rail 3 is lower than the inner portion 3*b* thereof and is of a stepwise configuration, if the inner sliding sash 5 is located at its lowermost position and the outer sliding sash 6 is located at its uppermost position as shown in FIG. 3, then the upper portion of the inner sliding sash 5; that is, the upper rail 12 will overlap the lower portion of the outer sliding sash 6; that is, the lower rail 43 with each other in the vertical direction so that the window frame 1 can be closed. Whilst, if the inner sliding sash 5 is located to its uppermost position and the outer sliding sash 6 is located at its lowermost position in the reverse manner as shown in FIG. 2, then the lower portion of the inner sliding sash 5; that is, the lower rail 13 is vertically spaced apart from the upper portion of the outer sliding sash 6; that is, the upper rail 42 by a distance W. If, in this condition, the locking rods 62 of the outer sliding sash locks 50 are moved to their withdrawal positions to withdraw them from the inward recesses 40*a* formed in the auxiliary vertical frames 40, then the outer sliding sash unit 41 can be inclined inwardly about the hinge 49 thereby making it possible to clean the outer surface of the glass of the outer sliding sash unit 41 readily.

Further, in order to achieve the same functions obtainable by the arrangement as shown in FIGS. 2 and 3, it is possible to form only the inner sliding sash receiving recess 70 in the upper frame 2, or form only the lower frame 3 stepwise.

Stating in brief, it is only necessary to define the configuration of the upper frame 2 or the lower frame 3 in such a manner that when the inner sliding sash 5 is located at its lowermost position and the outer sliding sash 6 is located at its uppermost position the upper portion of the inner sliding sash 5 overlaps the lower portion of the outer sliding sash 6, whilst when the inner sliding sash 5 is located at its uppermost position and the outer sliding sash 6 is located at its lowermost position the lower portion of the inner sliding sash 5 is spaced apart from the upper portion of the outer sliding sash 6.

Further, if it is desired to clean the outer surface of the glass readily, it is only necessary to mount the inner and outer sliding sashes 5 and 6 in the auxiliary stile-rail assembly so that the inner and outer sliding sash units can be inclined inwardly around their respective hinges, or make arrangement to allow the auxiliary vertical frames 10, 40 and the stiles of the auxiliary stile-rail assembly to slidably move directly along the left and right vertical frames 4, 4 of the window frame 1, or alternatively make arrangement to allow inner and outer slides to slide freely along the left and right vertical frames 4, 4 of the window frame and connect the inner and outer sliding sash units to the inner and outer slides so that the inner and outer sliding sash units can be inclined inwardly around their respective hinges.

It is to be understood that the foregoing description is merely illustrative of preferred embodiments of the present invention, and that the scope of the invention is not to be limited thereto, but is to be determined by the scope of the appended claims.

We claim:

1. A double-hung window, comprising:

a window frame;

an inner sliding sash mounted so as to be slidably moved up and down freely within said window frame on an inside of said window frame, said inner sliding sash having an inner sliding sash unit mounted thereon and a hinge so that said inner sliding sash unit may be inclined inwardly about said hinge, an outer sliding sash mounted so as to be slidably moved up and down freely within said window frame on an outside of said window frame, said outer sliding sash having an outer sliding sash unit mounted thereon and a hinge so that said outer sliding sash unit may be inclined inwardly about said hinge, said window frame having upper and lower frames configured such that when said inner sliding sash is located at a lowermost position and said outer sliding sash is located at an uppermost position an upper portion of said inner sliding sash overlaps a lower portion of said outer sliding sash, whilst when said inner sliding sash is located at an uppermost position and said outer sliding sash is located at a lowermost position a lower portion of said inner sliding sash is spaced apart from an upper portion of said outer sliding sash;

sash locks mounted on respective upper portions of each of said inner sliding sash unit and said outer sliding sash unit, said sash locks being slidably movable between locked and unlocked positions in horizontal directions; and means for securing said sash locks in each of said locked and unlocked positions, said means comprising:

a knob movable in a direction perpendicular to a sliding direction of said sash locks into and out of securing openings; and means for biasing said knob toward a securing position.

2. A double-hung window, comprising:

a window frame;

an inner sliding sash mounted so as to be slidably moved up and down freely within said window frame on an inside of said window frame, said inner sliding sash comprises:

an inner sliding sash unit having left and right stiles, auxiliary vertical frames connected, respectively, to said left and right stiles of said inner sliding sash unit, hinges fixedly secured, respectively, to lower parts of opposite inside portions of said auxiliary vertical frames, engaging members fixedly secured, respectively, to lower parts of outside portions of said left and right stiles of said inner sliding sash unit and which are engaged with said hinges so that said inner sliding sash unit may be inclined inwardly about said hinges relative to said auxiliary vertical frames, inner sliding sash locks mounted, respectively, on each end of an upper rail of said inner sliding sash unit and each of said left and right auxiliary vertical frames for sliding movement between locked and unlocked positions, said sash locks being secured in at least one of said locked and unlocked positions by locking rods fitting into recesses, and connecting members and socket members mounted on said left and right auxiliary vertical frames at upper and lower positions thereof, respectively, said connecting members and said socket members being vertically slidably engaged with inside guide recesses formed so as to extend, respectively, in a longitudinal direction of opposite inside portions of the left and right vertical frame members of the window frame;

an outer sliding sash mounted so as to be slidably moved up and down freely within said window frame on an outside of said window frame, said outer sliding sash having an outer sliding sash unit mounted thereon and a hinge so that said outer sliding sash unit may be inclined inwardly about said hinge, and said window frame having upper and lower frames configured such that when said inner sliding sash is located at a lowermost position and said outer sliding sash is located at an uppermost position an upper portion of said inner sliding sash overlaps a lower portion of said outer sliding sash, whilst when said inner sliding sash is located at an uppermost position and said outer sliding sash is located at a lowermost position a lower portion of said inner sliding sash is spaced apart from an upper portion of said outer sliding sash.

3. A double-hung window, comprising:

a window frame;

an inner sliding sash mounted so as to be slidably moved up and down freely within said window frame on an inside of said window frame, said inner sliding sash having an inner sliding sash unit mounted thereon and a hinge so that said inner sliding sash unit may be inclined inwardly about said hinge, and an outer sliding sash mounted so as to be slidably moved up and down freely within said window frame on an outside of said window frame, said outer sliding sash comprises:

an outer sliding sash unit, auxiliary vertical frames connected, respectively, to the left and right stiles of the outer sliding sash unit, hinges fixedly secured, respectively, to the lower parts of the opposite inside portions of the auxiliary vertical frames, engaging members fixedly secured, respectively, to the lower parts of the outside portions of the left and right stiles of said outer sliding sash unit and which are engaged with said hinges so that the outer sliding sash unit may be inclined inwardly about its hinge relative to said auxiliary vertical frames, outer sliding sash locks, mounted, respectively, across each side of the upper rail of said outer sliding sash unit and each of said left and right auxiliary vertical frames, said sash locks being secured in at least one of locked and unlocked positions by locking rods fitting into recesses, and connecting members and socket members mounted on said left and right auxiliary vertical frames at upper and lower positions thereof, respectively, so that they may be vertically slidably engaged with outside guide recesses formed so as to extend, respectively in the longitudinal direction of the opposite inside portions of the left and right vertical frame members of the window frame;

said window frame having upper and lower frames configured such that when said inner sliding sash is located at a lowermost position and said outer sliding sash is located at an uppermost position an upper portion of said inner sliding sash overlaps a lower portion of said outer sliding sash, whilst when said inner sliding sash is located at an uppermost position and said outer sliding sash is located at a lowermost position a lower portion of said inner sliding sash is spaced apart from an upper portion of said outer sliding sash.

* * * * *

UNITED STATES PATENT AND TRADEMARK OFFICE

CERTIFICATE OF CORRECTION

PATENT NO. : 5,035,081

DATED : July 30, 1991

INVENTOR(S) : Yukio Yamamoto and Masahiro Sugiura

It is certified that error appears in the above—identified patent and that said Letters Patent is hereby corrected as shown below:

On the Cover Page of the issued patent insert the following:

[30] Foreign Application Priority Data
June 1, 1988 [JP] Japan 63-71743

Signed and Sealed this

Tenth Day of November, 1992

*Attest:*

DOUGLAS B. COMER

*Attesting Officer*

*Acting Commissioner of Patents and Trademarks*